US005749981A

United States Patent [19]

Tonteling et al.

[11] Patent Number: 5,749,981

[45] Date of Patent: *May 12, 1998

[54] PROCESS FOR PRODUCING PATENTED STEEL WIRE

[75] Inventors: Charles N. A. Tonteling, Bissen, Luxembourg; Kenneth Joseph Palmer, Wadsworth; Farrel Bruce Helfer, Akron, both of Ohio; Rodger Todd, Heffingen; Josy Jean Blum, Ell, both of Luxembourg

[73] Assignee: The Goodyear Tire & Rubber Company, Akron, Ohio

[ * ] Notice: The term of this patent shall not extend beyond the expiration date of Pat. No. 5,595,617.

[21] Appl. No.: 767,467

[22] Filed: Dec. 16, 1996

Related U.S. Application Data

[63] Continuation of Ser. No. 475,734, Jun. 7, 1995, Pat. No. 5,595,617, which is a continuation of Ser. No. 44,785, Apr. 12, 1993, abandoned.

[51] Int. Cl.[6] ..... C22C 38/00

[52] U.S. Cl. ..... 148/595; 148/599

[58] Field of Search ..... 148/595, 599, 148/662, 663

[56] References Cited

U.S. PATENT DOCUMENTS

| | | | |
|---|---|---|---|
| 5,125,987 | 6/1992 | Eguchi et al. | 148/595 |
| 5,167,727 | 12/1992 | Kim et al. | 524/407 |
| 5,595,617 | 1/1997 | Tonteling et al. | 148/595 |

FOREIGN PATENT DOCUMENTS

| | | | |
|---|---|---|---|
| 04-289127 | 10/1992 | Japan | 148/595 |

*Primary Examiner*—Sikyin Ip
*Attorney, Agent, or Firm*—Alvin T. Rockhill

[57] ABSTRACT

The present process comprising the steps of:

(1) heating a steel wire to a temperature which is within the range of approximately 850° C. to about 1050° C. for a period of at least about 2 seconds; wherein said steel wire is comprised of a microalloyed high carbon steel which consists essentially of about 97.03 to about 98.925 weight percent iron, from about 0.72 to about 0.92 weight percent carbon, from about 0.3 to about 0.8 weight percent manganese, from about 0.05 to about 0.4 weight percent silicon, and from about 0.005 to about 0.85 weight percent of at least one member selected from the group consisting of chromium, vanadium, nickel, and boron, with the proviso that the total amount of silicon, manganese, chromium, vanadium, nickel, and boron in the microalloyed high carbon steel is within the range of about 0.7 to 0.9 weight percent;

(2) continuously cooling the steel wire at a cooling rate of less than 100° C. per second until a transformation from austenite to pearlite begins;

(3) allowing the transformation from austenite to pearlite to proceed with an increase in the wire temperature resulting from recalescence; and (4) cooling the patented steel wire to ambient temperature.

15 Claims, No Drawings

PROCESS FOR PRODUCING PATENTED STEEL WIRE

This is a continuation of application Ser. No. 08/475,734, filed on Jun. 7, 1995 U.S. Pat. No. (5,595,617 which is a Continuation of Ser. No. 08/044,785, filed on Apr. 12, 1993 (now abandoned).

BACKGROUND OF THE INVENTION

It is frequently desirable to reinforce rubber articles, for example, tires, conveyor belts, power transmission belts, timing belts, hoses, and the like products, by incorporating therein steel reinforcing elements. Pneumatic vehicle tires are often reinforced with cords prepared from brass coated steel filaments. Such tire cords are frequently composed of high carbon steel or high carbon steel coated with a thin layer of brass. Such a tire cord can be a monofilament, but normally is prepared from several filaments which are stranded or bunched together. In some instances, depending upon the type of tire being reinforced, the strands of filaments are further cabled to form the tire cord.

It is important for the steel alloy utilized in filaments for reinforcing elements to exhibit high strength and ductility as well as high fatigue resistance. Unfortunately, many alloys which possess this demanding combination of requisite properties cannot be processed in a practical commercial operation. The alloys which have proved to be commercially important have typically required a patenting procedure wherein they are subjected to an isothermal transformation from austenite to pearlite. U.S. Pat. No. 5,167,727 describes such a process wherein steel filaments are manufactured utilizing a patenting step wherein the transformation from austenite to pearlite is carried out under isothermal conditions at a temperature which is within the range of about 540° C. to about 620° C. Such isothermal transformations are normally carried out in a fluidized bed or in a molten lead medium to maintain a constant temperature for the duration of the transformation. However, the utilization of such an isothermal transformation step requires special equipment and adds to the cost of the patenting procedure.

A fine lamellar spacing between carbide and ferrite platelets in the patented steel wire is required to develop high tensile strengths while maintaining the good ductility required for drawing the wire. To achieve this goal, small quantities of various alloying metals are sometimes added to the steel in order to improve the mechanical properties which can be attained by using isothermal patenting techniques.

An alternative to isothermal patenting is continuous cooling or "air" patenting. In this process, high carbon steel wire is allowed to cool in air or another gas, such as cracked ammonia, which can be either still or forced in order to control the rate of cooling. This process typically produces a microstructure which has a lamellar structure which is somewhat coarser than that achieved with isothermal patenting. As a result, the tensile strength of the wire is significantly lower than that achieved by isothermal patenting and filaments drawing from the wire have lower tensile strengths. An additional drawback to the use of continuous cooling in patenting procedures is that as the diameter of the wire increases, the rate at which the wire cools is reduced and the microstructure becomes even coarser. As a result, it is more difficult to produce wires of a larger diameter with acceptable properties.

SUMMARY OF THE INVENTION

This invention discloses a technique for producing patented steel wire which has good ductility and which can be drawn to develop high tensile strength. Such patented steel wire is particularly suitable for utilization in manufacturing reinforcing wire for rubber products, such as tires. By utilizing this process, continuous cooling can be employed in the patenting procedure with the properties attained being more representative of those which are normally only attained under conditions of isothermal transformation.

It has been unexpectedly found that certain microalloyed high carbon steel wires having good ductility and which can be drawn to develop high tensile strength can be prepared by a patenting procedure which utilizes a continuous cooling step for the transformation from austenite to pearlite. These plain carbon steels are comprised of about 97.03 weight percent to about 98.925 weight percent iron, from about 0.72 weight percent to about 0.92 weight percent carbon, from about 0.3 weight percent to about 0.8 weight percent manganese, from about 0.05 weight percent to about 0.4 weight percent silicon, and from about 0.005 weight percent to about 0.85 weight percent of at least one member selected from the group consisting of chromium, vanadium, nickel and boron. The total amount of silicon, manganese, chromium vanadium, nickel, and boron in such microalloyed high carbon steel is within the range of about 0.7 weight percent to 0.9 weight percent. By utilizing such alloys, the costly equipment required for isothermal transformation is eliminated. This, in turn, simplifies and reduces the cost of the patenting procedure.

The subject invention more specifically describes a process for producing a patented steel wire having a microstructure which is essentially pearlite with a very fine lamellar spacing between carbide and ferrite platelets which has good ductility and which can be drawn to develop high tensile strength, said process comprising the steps of:

(1) heating a steel wire to a temperature which is within the range of approximately 850° C. to about 1050° C. for a period of at least about 2 seconds; wherein said steel wire is comprised of a microalloyed high carbon steel which consists essentially of about 97.03 to about 98.925 weight percent iron, from about 0.72 to about 0.92 weight percent carbon, from about 0.3 to about 0.8 weight percent manganese, from about 0.05 to about 0.4 weight percent silicon, and from about 0.005 to about 0.85 weight percent of at least one member selected from the group consisting of chromium, vanadium, nickel, and boron, with the proviso that the total amount of silicon, manganese, chromium, vanadium, nickel, and boron in the microalloyed high carbon steel is within the range of about 0.7 to 0.9 weight percent;

(2) continuously cooling the steel wire at a cooling rate of less than 100° C. per second until a transformation from austenite to pearlite begins;

(3) allowing the transformation from austenite to pearlite to proceed with an increase in the wire temperature resulting from recalescence; and (4) cooling the patented steel wire to ambient temperature.

DETAILED DESCRIPTION OF THE INVENTION

Certain plain carbon steel microalloys are utilized in the process of this invention. These microalloyed high carbon steels consist essentially of about 97.03 weight percent to about 98.925 weight percent iron, from about 0.72 weight percent to about 0.92 weight percent carbon, from about 0.3 weight percent to about 0.8 weight percent manganese, from about 0.05 weight percent to about 0.4 weight percent silicon, and from about 0.005 weight percent to about 0.85 weight percent of at least one member selected from the group consisting of chromium, vanadium, nickel and boron; with the total amount of silicon, manganese, chromium, vanadium, nickel, and boron in the microalloyed high carbon steel being within the range of about 0.7 weight percent to 0.9 weight percent. In other words, the total quantity of chromium, vanadium, nickel and boron in the microalloy will total 0.005 weight percent to 0.85 weight percent of the total microalloy and the total quantity of silicon, manganese, chromium, vanadium, nickel, and boron in the microalloy will total about 0.7 to 0.9 weight percent. In most cases, only one of the members selected from the group consisting of chromium, vanadium, nickel and boron will be present in the microalloy.

It is generally preferred for the microalloy to consist essentially of from about 97.82 weight percent to about 98.64 weight percent iron, from about 0.76 weight percent to about 0.88 weight percent carbon, from about 0.40 weight percent to about 0.60 weight percent manganese, from about 0.15 weight percent to about 0.30 weight percent silicon, and from about 0.05 weight percent to about 0.4 weight percent of at least one member selected from the group consisting of chromium, vanadium, and nickel. In cases where boron is used in the microalloy it is generally preferred for the microalloy to consist essentially of from about 98.12 weight percent to about 98.68 weight percent iron, from about 0.76 weight percent to about 0.88 weight percent carbon, from about 0.40 weight percent to about 0.60 weight percent manganese, from about 0.15 weight percent to about 0.30 weight percent silicon, and from about 0.01 weight percent to about 0.1 weight percent of boron.

It is normally more preferred for the high carbon steel microalloy to consist essentially of from about 98.05 weight percent to about 98.45 weight percent iron, from about 0.8 weight percent to about 0.85 weight percent carbon, from about 0.45 weight percent to about 0.55 weight percent manganese, from about 0.2 weight percent to 0.25 weight percent silicon, and from about 0.1 weight percent to about 0.3 weight percent of at least one element selected from the group consisting of chromium, vanadium, and nickel. In cases where boron is included in the microalloy it is normally more preferred for the high carbon steel microalloy to consist essentially of from about 98.30 weight percent to about 98.54 weight percent iron, from about 0.8 weight percent to about 0.85 weight percent carbon, from about 0.45 weight percent to about 0.55 weight percent manganese, from about 0.2 weight percent to 0.25 weight percent silicon, and from about 0.01 weight percent to about 0.05 weight percent boron. It is generally most preferred for such microalloys to contain a total of about 0.75 weight percent to about 0.85 weight percent of silicon, manganese, chromium, vanadium, nickel, and boron.

Rods having a diameter of about 5 mm to about 6 mm which are comprised of the steel alloys of this invention can be manufactured into steel filaments which can be used in reinforcing elements for rubber products. Such steel rods are typically cold drawn to a diameter which is within the range of about 1.2 mm to about 2.4 mm and which is preferably within the range of 1.6 mm to 2.0 mm. For instance, a rod having a diameter of about 5.5 mm can be cold drawn to a wire having a diameter of about 1.8 mm. This cold drawing procedure increases the strength and hardness of the metal.

The cold drawn wire is then patented by heating the wire to a temperature which is within the range of 850° C. to about 1100° C. and allowing the wire to continuously cool to ambient temperature. In cases where the wire is heated by electrical resistance by passing an electrical current through it, the heating time is typically between 2 seconds and 10 seconds. In cases where electrical resistance heating is used, the heating period is more typically within the range of about 4 to about 7 seconds and the heating temperature is typically within the range of 950° C. to about 1050° C. It is, of course, also possible to heat the wire in a fluidized bed oven. In such cases, the wire is heated in a fluidized bed of sand having a small grain size. In fluidized bed heating techniques, the heating period will generally be within the range of about 5 seconds to about 30 seconds. It is more typical for the heating period in a fluidized bed oven to be within the range of about 10 seconds to about 20 seconds. It is also possible to heat the wire in a convection oven or in a furnace. In this case the heating time will be in the range of about 25 seconds to 50 seconds.

The exact duration of the heating period is not critical. However, it is important for the temperature to be maintained for a period which is sufficient for the alloy to be austenitized. The alloy is considered to be austenitized after the microstructure has been completely transformed to a homogeneous face centered cubic crystal structure.

In the next step of the patenting procedure, the austenite wire is continuously cooled at a cooling rate of less than 100° C. per second. In most cases, the cooling rate employed will be between 20° C. per second and 70° C. per second. It is normally preferred to utilize a cooling rate which is within the range of about 40° C. per second to 60° C. per second. This continuous cooling step can be brought about by simply allowing the wire to cool in air or another suitable gas, such as cracked ammonia. The gas can be still or circulated to control the rate of cooling.

The continuous cooling is carried out until a transformation from austenite to pearlite begins. This transformation will typically begin at a temperature which is within the range of about 500° C. to about 650° C. The transformation from austenite to pearlite will more typically begin at a temperature which is within the range of about 540° C. to about 600° C. The transformation will more typically begin at a temperature which is within the range of about 550° C. to about 580° C.

After the transformation from austenite to pearlite begins, the temperature of the wire will increase from recalescence. At this point in the process, the transformation is simply allowed to proceed with the temperature of the wire increasing solely by virtue of the heat given off by the transformation. A temperature increase which is within the range of about 20° C. to about 70° C. will normally be experienced. A temperature increase of 30° C. to 60° C. will more typically be experienced. It is more typical for the temperature of the wire to increase by about 40° C. to about 50° C. during the transformation.

The transformation from austenite to pearlite typically takes from about 0.5 seconds to about 4 seconds to complete. The transformation from austenite to pearlite will more typically take place over a time period within the range of about 1 second to about 3 seconds. The transformation is considered to begin at the point where a temperature increase due to recalescence is observed. As the transformation proceeds, the microstructure is transformed from a face centered cubic microstructure of the austenite to pearlite. The patenting procedure is considered to be completed after the transformation to pearlite has been attained wherein the pearlite is a lamellar structure consisting of an iron phase having a body centered cubic crystal structure and a carbide phase. After the patenting has been completed, the steel wire can be simply cooled to ambient temperature.

In some instances it may not be possible to draw the wire directly from wire rod to a diameter suitable for final patenting. In these cases the wire may be initially cold drawn, to reduce its diameter between about 40% to about 80%, to a diameter in the range of approximately 3.8 mm to 2.5 mm. After this initial drawing the wire is then patented in a process referred to as intermediate patenting, by using a similar process to the one used in the first patenting step with the exception that the heating times are generally longer. After intermediate patenting, the wire is cold drawn to a final diameter suitable for the final patenting step described above.

After final patenting the steel wire is then typically brass plated For instance, alloy plating can be used to plate the steel wire with a brass coating. Such alloy plating procedures involve the electrodeposition of copper and zinc unto the wire simultaneously to form a homogeneous brass alloy insitu from a plating solution containing chemically complexing species. This codeposition occurs because the complexing electrolyte provides a cathode film in which the individual copper and zinc deposition potentials are virtually identical. Alloy plating is typically used to apply alpha-brass coatings containing about 70% copper and 30% zinc. Such coatings provide excellent drawing performance and good initial adhesion.

Sequential plating is also a practical technique for applying brass alloys to steel wires. In such procedures a copper layer and a zinc layer are sequentially plated onto the steel wire by electrodeposition followed by a thermal diffusion step. Such a sequential plating process is described in U.S. Pat. No. 5,100,517 which is hereby incorporated by reference.

In the standard procedure for plating brass onto steel wire, the steel wire is first optionally rinsed in hot water at a temperature of greater than about 60° C. The steel wire is then acid pickled in sulfuric acid or hydrochloric acid to remove oxide from the surface. After a water rinse, the wire is coated with copper in a copper pyrophosphate plating solution. The wire is given a negative charge so as to act as a cathode in the plating cell. Copper plates are utilized as the anode. Oxidation of the soluble copper anodes replenishes the electrolyte with copper ions. The copper ions are, of course, reduced at the surface of the steel wire cathode to the metallic state.

The copper plated steel wire is then rinsed and plated with zinc in a zinc plating cell. The copper plated wire is given a negative charge to act as the cathode in the zinc plating cell. A solution of acid zinc sulfate is in the plating cell which is equipped with a soluble zinc anode. During the zinc plating operation, the soluble zinc anode is oxidized to replenish the electrolyte with zinc ions. The zinc ions are reduced at the surface of the copper coated steel wire which acts as a cathode with a layer of zinc being deposited thereon. The acid zinc sulfate bath can also utilize insoluble anodes when accompanied with a suitable zinc ion replenishment system.

The copper/zinc plated wire is then rinsed and heated to a temperature of greater than about 450° C. and preferably within the range of about 500° C. to about 550° C. to permit the copper and zinc layers to diffuse thereby forming a brass coating. This is generally accomplished by induction or resistance heating. The filament is then cooled and washed in a dilute phosphoric acid bath at room temperature to remove oxide. The brass coated wire is then rinsed and air dried at a temperature of about 75° C. to about 150° C. In some cases it may be desirable to coat the steel alloy with an iron-brass coating. Such a procedure for coating steel reinforcing elements with a ternary iron-brass alloy is described in U.S. Pat. No. 4,446,198, which is incorporated herein by reference.

After brass plating, the wire is again cold drawn while submerged in a bath of liquid lubricant. In this step the cross section of the wire is reduced by about 80% to about 99% to produce the high strength filaments used for elastomeric reinforcements. It is more typical for the wire to be reduced by about 96% to about 98%. The diameters of the high strength filaments produced by this process are typically within the range of about 0.15 mm to about 0.40 mm. More typically the high strength filaments produced have a diameter which is within the range of about 0.25 mm to about 0.35 mm.

In many cases it will be desirable to twist two or more filaments into cable for utilization as reinforcements for rubber products. For instance, it is typical to twist two such filaments into cable for utilization in passenger tires. It is, of course, also possible to twist a larger number of such filaments into cable for utilization in other applications. For instance, it is typical to twist about 50 filaments into cables which are ultimately employed in earth mover tires.

The present invention will be described in more detail in the following examples. These examples are merely for the purpose of illustration and are not to be regarded as limiting the scope of the invention or the manner in which it may be practiced. Unless specifically indicated otherwise, all parts and percentages are given by weight.

EXAMPLE 1

In this experiment, a chromium containing high carbon steel microalloy wire was patented utilizing a technique which included a continuous cooling step. The microalloy utilized in this experiment contains approximately 98.43 percent iron, 0.85 percent carbon, 0.31 percent manganese, 0.20 percent silicon, and 0.21 percent chromium. In the process used, the chromium containing microalloy wire was very quickly heated by electrical resistance over a period of about 5 seconds to a peak temperature of about 950° C. This heating cycle was sufficient to austenitize the wire which was then allowed to continuously cool in air at a cooling rate of about 40° C. per second. After the wire had cooled to a temperature of about 580° C., a transformation from austenite to pearlite began. This transformation caused the temperature of the wire to increase to about 625° C. over a period of about 1 second after which the wire again began to continuously cool. The patented wire produced had a diameter of 1.75 mm and was determined to have a tensile strength of 1260 MPa (megapascals). The patented wire was also determined to have an elongation at break of 10.5 percent and a reduction of area at break of 47 percent.

The patented wire was subsequently cold drawn into a filament having a diameter of 0.301 mm. The filament made was determined to have a tensile strength of 3349 MPa and had an elongation at break of 2.61 percent. The tensile strength of the filaments made in this experiment utilizing the chromium containing high carbon steel microalloy compare very favorably to those which can be realized utilizing isothermal patenting techniques which employ standard 1080 carbon steel. More importantly, this experiment shows that very outstanding filament tensile strength can be realized utilizing a patenting procedure wherein a continuous cooling step is employed.

COMPARATIVE EXAMPLE 2

This experiment was carried out utilizing the same procedure as is described in Example 1 except for the fact that a 1080 carbon steel which contained about 98.47 percent iron, 0.83 percent carbon, 0.48 percent manganese, and 0.20 percent silicon was substituted for the chromium containing microalloy utilized in Example 1. The patented 1080 carbon steel wire made had a tensile strength of 1210 MPa with the drawn filament produced having a tensile strength of only 3171 MPa. The filament made was also determined to have an elongation at break of 2.52 percent. This example shows that the utilization of the chromium containing microalloy described in Example 1 resulted in a filament tensile strength increase of 178 MPa.

EXAMPLE 3

This experiment was also carried out utilizing the general procedure described in Example 1 except that a vanadium containing plain carbon steel microalloy was utilized. The patented wire produced in this experiment was determined to have a tensile strength of 1311 MPa, an elongation at break of 10 percent, and a reduction of area at break of 48 percent. The filament made in this experiment was determined to have a tensile strength of 3373 MPa and an elongation at break of 2.57 percent. This example shows that the tensile strength of the filaments was further improved by utilizing the vanadium containing microalloy.

While certain representative embodiments and details have been shown for the purpose of illustrating the subject invention, it will be apparent to those skilled in this art that various changes and modifications can be made therein without departing from the scope of the subject invention.

What is claimed is:

1. A process for producing a high strength filament for use in elastomeric reinforcements, said process comprising the steps of:

(1) heating a steel wire to a temperature which is within the range of approximately 850° C. to about 1050° C. for a period of at least about 2 seconds;

wherein said steel wire is comprised of a microalloyed high carbon steel which consists essentially of about 97.03 to about 98.925 weight percent iron, from about 0.72 to about 0.92 weight percent carbon, from about 0.3 to about 0.8 weight percent manganese, from about 0.05 to about 0.4 weight percent silicon, and from about 0.005 to about 0.85 weight percent of at least one member selected from the group consisting of chromium, vanadium, nickel, and boron, with the proviso that the total amount of silicon, manganese, chromium, vanadium, nickel and boron in the microalloyed high carbon steel is within the range of about 0.7 to 0.9 weight percent;

(2) continuously cooling the steel wire at a cooling rate of 20° C. to 60° C. per second to a temperature which is within the range of about 500° C. to about 650° C. until a transformation from austenite to pearlite begins;

(3) allowing the transformation from austenite to pearlite to proceed with an increase in the wire temperature resulting from recalescence to produce a patented steel wire, wherein the increase in wire temperature resulting from recalescence is an increase in temperature which is within the range of about 20° C. to about 70° C.;

(4) cooling the patented steel wire to ambient temperature;

(5) brass-plating the patented steel wire to produce a brass-plated steel wire; and;

(6) cold-drawing the brass-plated steel wire to a diameter which is within the range of about 0.15 mm to about 0.40 mm to produce a high strength filament.

2. A process as specified in claim 1 wherein the microalloyed high carbon steel consists essentially of from about 98.12 weight percent to about 98.68 weight percent iron, from about 0.76 weight percent to about 0.88 weight percent carbon, from about 0.40 weight percent to about 0.60 weight percent manganese, from about 0.15 weight percent to about 0.30 weight percent silicon, and from about 0.01 weight percent to about 0.1 weight percent of boron.

3. A process as specified in claim 1 wherein the microalloyed high carbon steel consists essentially of from about 97.82 weight percent to about 98.64 weight percent iron, from about 0.76 weight percent to about 0.88 weight percent carbon, from about 0.40 weight percent to about 0.60 weight percent manganese, from about 0.15 weight percent to about 0.30 weight percent silicon, and from about 0.05 weight percent to about 0.4 weight percent of at least one member selected from the group consisting of chromium, vanadium, and nickel.

4. A process as specified in claim 1 wherein the microalloyed high carbon steel consists essentially of from about 98.05 weight percent to about 98.45 weight percent iron, from about 0.8 weight percent to about 0.85 weight percent carbon, from about 0.45 weight percent to about 0.55 weight percent manganese, from about 0.2 weight percent to 0.25 weight percent silicon, and from about 0.1 weight percent to about 0.3 weight percent of at least one element selected from the group consisting of chromium, vanadium, and nickel.

5. A process as specified in claim 1 wherein the microalloyed high carbon steel consists essentially of from about 98.30 weight percent to about 98.54 weight percent iron, from about 0.8 weight percent to about 0.85 weight percent carbon, from about 0.45 weight percent to about 0.55 weight percent manganese, from about 0.2 weight percent to 0.25 weight percent silicon, and from about 0.01 weight percent to about 0.05 weight percent boron.

6. A process as specified in claim 5 wherein the microalloyed high carbon steel contains a total of about 0.75 weight percent to about 0.85 weight percent of silicon, manganese, chromium, vanadium, nickel, and boron.

7. A process as specified in claim 1 wherein the microalloyed high carbon steel consists essentially of iron, carbon, manganese, silicon, and chromium.

8. A process as specified in claim 7 wherein the plain carbon steel microalloy consists essentially of from 97.82 weight percent to about 98.64 weight percent iron, from about 0.76 weight percent to about 0.88 weight percent carbon, from about 0.40 weight percent to about 0.60 weight percent manganese, from about 0.15 weight percent to about 0.30 weight percent silicon, and from about 0.05 to about 0.4 weight percent chromium.

9. A process as specified in claim 8 wherein the steel wire is heated in step (1) to a temperature which is within the range of about 900° C. to about 1075° C.

10. A process as specified in claim 9 wherein the transformation from austenite to pearlite begins at a temperature which is within the range of about 500° C. to about 600° C.

11. A process as specified in claim 10 wherein the increase in wire temperature resulting from recalescence is an increase in temperature which is within the range of 30° C. to 60° C.

12. A process as specified in claim 10 wherein the plain carbon steel microalloy consists essentially of from about 98.05 weight percent to about 98.45 weight percent iron, from about 0.8 weight percent to about 0.85 weight percent carbon, from about 0.45 weight percent to about 0.55 weight percent manganese, from about 0.2 weight percent to about 0.25 weight percent silicon, and from about 0.1 weight percent to about 0.3 weight percent chromium.

13. A process as specified in claim 12 wherein the transformation from austenite to pearlite occurs over a period of about 0.5 seconds to about 4 seconds.

14. A process as specified in claim 13 wherein the continuous cooling of step (2) is carried out in air.

15. A process as specified in claim 14 wherein the increase in wire temperature resulting from recalescence is an increase in temperature which is within the range of 40° C. to 50° C.

* * * * *